US005196394A

United States Patent [19]

Nakazawa et al.

[11] Patent Number: 5,196,394

[45] Date of Patent: Mar. 23, 1993

[54] HEAT-SENSITIVE RECORDING MATERIAL

[75] Inventors: Atsushi Nakazawa; Hideaki Shinohara, both of Tokyo; Yoshitaka Tomino, Funabashi; Yoichi Shin, Yachiyo, all of Japan

[73] Assignee: Oji Paper Co., Ltd., Tokyo, Japan

[21] Appl. No.: 784,215

[22] Filed: Oct. 30, 1991

Related U.S. Application Data

[63] Continuation-in-part of Ser. No. 512,229, Apr. 20, 1990, Pat. No. 5,093,304.

[30] Foreign Application Priority Data

Apr. 2, 1990 [JP] Japan ..... 2-84815

[51] Int. Cl.[5] ..... B41M 5/40

[52] U.S. Cl. ..... 503/209; 427/152; 503/200; 503/226

[58] Field of Search ..... 503/200, 226, 209; 427/152

[56] References Cited

U.S. PATENT DOCUMENTS 4,614,956 9/1986 Miyauchi ..... 503/200

5,093,304 3/1992 Nakazawa et al. ..... 503/200

*Primary Examiner*—Pamela R. Schwartz

*Attorney, Agent, or Firm*—Armstrong, Westerman, Hattori, McLeland & Naughton

[57] ABSTRACT

A heat-sensitive recording material having a superior resistance against water, plasticizers, and oily substances, is provided with a heat-sensitive color-forming layer formed on a surface of a substrate sheet and comprising a dye precursor, a color-developing agent, and a binder; and a protecting layer formed on the heat-sensitive color-forming layer and comprising (A) a polyvinylalcohol resin, (B) a water-soluble cross-linking agent, (C) at least one organic boron-containing polymer of the formula (I):

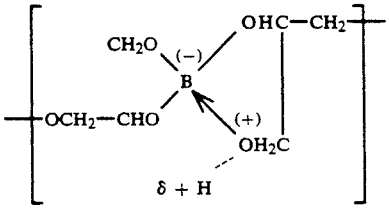

100 or more, and optionally (D) an acetoacetylated polyvinylalcohol resin.

18 Claims, No Drawings

HEAT-SENSITIVE RECORDING MATERIAL

CROSS REFERENCE TO RELATED APPLICATION

This application is a continuation-in-part application of our application Ser. No. 07/512,229,filed on Apr. 20, 1990, now U.S. Pat. No. 5,093,304.

BACKGROUND OF THE INVENTION

1. Field of the Invention

The present invention relates to a heat-sensitive recording material More particularly, the present invention relates to a heat-sensitive recording material having a superior storage durability, a high water-resistance of the heat-sensitive color-forming layer thereof and color-developed images thereon, and a superior resistance of the color-developed images to color-fading when the color-developed images on the heat-sensitive color-forming layer are brought into contact with a thermoplastic resin film containing a plasticizer and with an oily substance, for example, an edible meat, oil or fat, respectively 2. Description of the Related Arts Conventional heat-sensitive recording materials produced by coating a surface of a substrate sheet with a coating material prepared by dispersing a mixture of a dye precursor consisting of a color-forming lactone compound, for example, crystal violet lactone, and a color-developing agent consisting of an organic acid or phenol compound, for example, bisphenol A, in a solution of a binder, for example, polyvinylalcohol, are disclosed in various prior art publications, for example, Japanese Examined Patent Publication (Kokoku) No. 45-14,039 and U.S. Pat. No. 3,539,375. When this type of heat-sensitive recording materials is heated, the color-forming lactone compound chemically reacts with the color-developing agent, for example, the organic acid or phenol compound, to form colored images These heat-sensitive recording materials must meet the following requirements:

(1) The colored images formed on the recording material must be clear and have a good color depth.

(2) The appearance of the recording materials must be close to that of conventional white paper sheets.

(3) The recording materials must be able to be stably stored over a long period.

(4) The heat-sensitivity of the recording materials must be satisfactory.

(5) The recording materials must not stick or adhere to each other or to a thermal head of a printing machine in which the recording materials are thermally printed.

(6) The recording materials must not cause the thermal head to be stained by grounds derived therefrom, and thus must have a good applicability to the thermal head.

The conventional heat-sensitive color-forming layers of the recording materials, however, are sensitive and not stable to light, water, heat, plasticizers and oily substances, and thus are deteriorated during storage thereof. Namely, where the conventional heat-sensitive recording materials are subjected to a thermal recording procedure, the color-forming layer can form clear colored images thereon, whereas where a thermoplastic resin film, for example, a soft polyvinyl chloride resin film, containing a certain amount of a plasticizer or an oily substance, for example, edible meat, oil or fat, is brought into close contact with a heat sensitive color-forming layer, the colored images formed on the color-forming layer are faded. Also when the color-forming layer is in contact with water over a long time, the colored images thereon are significantly faded.

The above-mentioned color-fading phenomenon is conspicuous in the color-developing type heat-sensitive recording materials in which a dye precursor comprising, as a main component, a colorless or light colored color-forming lactone compound, is used as a color-forming component.

It is assumed that the color-fading phenomenon of the colored images is not derived from the specific chemical structures of the color-forming lactone compound but is due to the fact that, when brought into contact with the thermoplastic resin films containing a plasticizer or with the oily substances, the color-developing agent, for example, an organic acid or phenol compound, is dissolved in the plasticizer in the thermoplastic resin film or in the oily substances. Therefore, there is a strong demand for a method of preventing of the color-fading of heat-sensitive recording materials.

To prevent color-fading, an attempt has been made to arrange a protective coating layer on the heat-sensitive color-forming layer in the heat-sensitive recording material. The protective coating layer comprises a water-soluble polymeric material, for example, polyvinylalcohol or casein, which can form a barrier against the plasticizers and oily substances, and a cross-linking agent. Nevertheless, even when the above-mentioned type of conventional protective coating layer is formed on the heat-sensitive color-forming layer, when brought into close contact with the plasticizer-containing plastic films or the oily substances, the colored images formed on the color-forming layer disappear within a time of from 0.5 to 5 hours, and thus the protection offered by the conventional protecting coating layer is unsatisfactory.

Japanese Unexamined Patent Publication (Kokai) No. 58-188687 and U.S. Pat. No. 4,485,139 disclose a heat-sensitive recording material in which a protective coating layer containing a mixture of a polyvinylalcohol resin and boric acid is arranged on a heat-sensitive color-forming layer, but this type of recording material is disadvantageous in that, in the formation of the protective coating layer, a vigorous gelation reaction occurs in the coating liquid containing the poly-vinylalcohol resin and boric acid, and thus the coating liquid exhibits a very poor stability and low durability (pot life). Japanese Unexamined Patent Publication (Kokai) No. 59-106,995 and U.S. Pat. No. 4,513,301 disclose a heat-sensitive recording material having a protective coating layer comprising, as a main component, at least one polymeric resin selected from acetoacetylated polyvinylalcohol resins and acrylo-nitrile-copolymerized polyvinylalcohol resins and a cross-linking agent, and arranged on a heat-sensitive color-forming layer. This type of the protective coating layer is disadvantageous in that the reaction between the polymeric resin and the cross-linking agent in a coating liquid for the protective coating layer is vigorous and causes a very rapid increase of the viscosity of the coating liquid. Therefore, it is impossible to smoothly and stably carry out the coating operation for the protective coating layer, and the coating liquid exhibits a low durability (pot life) due to the gelation thereof.

Japanese Unexamined Patent Publication (Kokai) No. 60 - 260,382 discloses a coating liquid to be applied to a heat-sensitive color-forming layer, which coating comprises a polyvinylalcohol resin aqueous solution to which a dehydration reaction product of 2 molar parts of glycerol with one molar part of boric acid is added. This coating liquid is disadvantageous in that it has a low storage durability (pot life), and thus is not suitable for practical use.

Japanese Unexamined Patent Publication (Kokai) No. 1-120,385, to the same inventors as in the present invention, discloses a protective coating layer coated on the heat-sensitive color-forming layer and comprising a polyvinylalcohol resin, a polyvinyl-alcohol derivative resin having acetoacetic ester groups attached to polyvinylalcohol polymeric molecules and a water soluble cross-linking agent reactive with the above-mentioned resins. This type of protective coating layer is not always satisfactory, and thus requires improvement.

Under the above circumstances, there is a strong demand that the above-mentioned disadvantages of the conventional heat-sensitive recording materials be eliminated.

SUMMARY OF THE INVENTION

An object of the present invention is to provide a heat-sensitive recording material having a superior resistance to the color-fading of colored images developed thereon due to the effects of light, water, heat, plasticizers, and oily substances applied thereto.

Another object of the present invention is to provide a heat-sensitive recording material capable of maintaining colored images formed thereon in an unchanged, clear state over a long period.

The above-mentioned objects can be attained by the heat-sensitive recording material of the present invention, comprising a substrate sheet;

a heat-sensitive color-forming layer formed on a surface of the substrate sheet and comprising a substantially colorless dye precursor, a color-developing agent reactive with the dye precursor upon heating to develop a color, and a binder, and at least one protective layer formed on the heat-sensitive color-forming layer and comprising, as a principal component, a mixture of:

(A) a polyvinylalcohol resin;

(B) a water-soluble cross-linking agent; and (C) an organic boron-containing a (I)

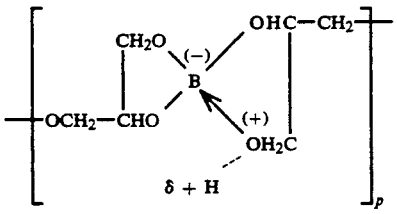

wherein p represents an integer of 10 or more. In the heat-sensitive recording material of the present invention, the principal component in the protective layer optionally comprises (D), an acetoacetylated polyvinylalcohol resin, in addition to the polyvinyl-alcohol resin (A), the water-soluble cross-linking agent (B), and the organic boron-containing polymer (C) of the formula (I).

DESCRIPTION OF THE PREFERRED EMBODIMENTS

The heat-sensitive recording material of the present invention comprises a substrate sheet, a heat-sensitive color-forming layer formed on a surface of the substrate sheet, and at least one protective layer formed on the heat-sensitive color-forming layer.

The protective layer formed on the heat-sensitive color-forming layer effectively acts as a barrier preventing a direct contact of the heat-sensitive color forming layer with a thermoplastic resin material containing a plasticizer or with an oily substance, and hindering a penetration of the plasticizer or the oily substance into the heat-sensitive color-forming layer. Therefore, the colored images formed on the heat-sensitive color-forming layer can be protected from fading by the protective layer, even when the plasticizer-containing plastic resin material or the oily substance is kept in contact with the heat-sensitive recording material of the present invention at a temperature of 40° C. for 24 hours or more.

Also, in the production of the heat-sensitive recording material of the present invention, the viscosity and storage durability (pot life), respectively, of the coating liquid for the protective layer can be easily controlled to a desired level.

Furthermore, even when the protective layer is modified to impart a water-proof property thereto, no discoloration of the modified protective layer occurs.

The protective layer of the present invention comprises, as a principal component, a mixture of (A) a polyvinylalcohol resin, (B) a water-soluble cross-linking agent, (C) an organic boron-containing polymer of the formula (I), and optionally, (D) an acetoacetylated polyvinylalcohol resin.

There is no restriction on the degree of polymerization and the degree of saponification of the polyvinylalcohol resins (A) usable for the prevent invention. Usually, the degree of polymerization of the polyvinylalcohol resins (A) is preferably in the range of from 300 to 2000. Particularly, the polyvinylalcohol resins (A) having a degree of polymerization of from 500 to 1000 are useful for providing a coating liquid for the protective layer having a proper viscosity and a satisfactory coating property.

Also, the polyvinylalcohol resins (A) preferably have a degree of saponification of 70% to 100%, more preferably 85% to 100%.

The acetoacetylated polyvinylalcohol resin (D), which is optionally contained in the protective layer of the present invention, comprises at least one type of acetoacetylated polyvinylalcohol polymer and has acetoacetic ester side chains attached to the backbone polyvinylalcohol molecule chains.

The acetoacetylation of polyvinylalcohol can be effected by an addition reaction of a polyvinylalcohol with a diketone compound, or by an ester-exchange reaction of an esterified polyvinylalcohol with an acetoacetic ester compound.

The acetoacetylated polyvinylalcohol resin (D) preferably- has a degree of polymerization of 700 to 2000, more preferably about 1000, for example, 900 to 1100.

Preferably, the acetoacetylated polyvinylalcohol resin (D) contains the acetoacetic ester groups in an amount of 0.05 molar % or more per mole of the backbone polyvinylalcohol molecule chains, and as long as the acetoacetylated polyvinylalcohol resin is water-soluble, there is no specific upper limit to the content of the acetoacetic ester groups in the polyvinylalcohol derivative resin (degree of acetoacetylation]. Preferably, the content of the acetoacetyl groups in the acetoacetyl polyvinylalcohol resin (D), i.e., the degree of acetoacetylation, is in the range of from 0.1 to 20 molar %, more preferably, from 0.5 to 10 molar %.

The acetoacetylated polyvinylalcohol resin (D) effectively enhances the barrier effect of the resultant protective layer against water, the plasticizers contained in the plastic resin films, and the oily substances.

If the content of the acetoacetic ester groups in the polyvinylalcohol derivative resin is too small, for example, less than 0.05 molar %, the resultant acetoacetylated polyvinylalcohol resin, may not provide a satisfactory protective barrier effect for the colored images on the heat-sensitive color-forming layer. If the content of the acetoacetic ester groups is too large, for example, more than 20 molar %, the resultant acetoacetylated polyvinylalcohol resin may be water-insoluble, and thus will not provide a satisfactory protective barrier effect for the colored images.

Preferably, the acetoacetylated polyvinylalcohol resin (D) i contained in an amount of 1 to 200 parts by weight, more preferably, 100 to 200 parts by weight, per 100 parts by weight of the amount of the polyvinylalcohol resin (A) in the protective layer.

The water-soluble cross-linking agent (B) usable for the present invention comprises at least one water-soluble cross-linking compound reactive with hydroxyl groups, and optionally, acetoacetic ester groups in the polyvinylalcohol resin (A), and further optionally, the acetoacetylated polyvinylalcohol resin (D).

The water-soluble cross-linking agent (B) preferably comprises at least one compound selected from the group consisting of elyoxal, polyformaldehydes, polyethyleneimines, epoxy group-containing polyamides, glyceroldiglycidylether, dimethylol urea, ammonium persulfate, iron (III) chloride, magnesium dichloride, ammonium chloride, and boric acid.

Preferably, the water-soluble cross-linking agent (B) is present in an amount of 1 to 30 parts by weight more preferably 2 to 15 parts by weight, per 100 parts by weight of the polyvinylalcohol resin (A), or of the sum of the polyvinylalcohol resin (A) and the acetoacetylated polyvinylalcohol resin (D).

The water-soluble cross-linking agent (B) effectively enhances the barrier effect of the protective layer against water, against the plasticizer in the plastic resin film, and against the oily materials, by cross-linking the polyvinylalcohol resin (A), and optionally, the acetoacetylated polyvinylalcohol resin (D). If the content of the water-soluble cross-linking agent (B) is less than 1 part by weight, the barrier effect of the resultant protective layer is often unsatisfactory, and if the content of the water-soluble cross-linking agent (B) is more than 30 parts by weight, the resultant protective layer is sometimes disadvantageous in that the resultant coating liquid for the heat-sensitive color-forming layer is often gelated, and thus exhibits an unsatisfactory film-forming property, and the resultant heat-sensitive color-forming layer sometimes exhibits a poor heat-sensitivity for the color-formation.

The protective layer of the present invention is characterized by containing therein the specific organic boron-containing polymer (C) of the formula (I):

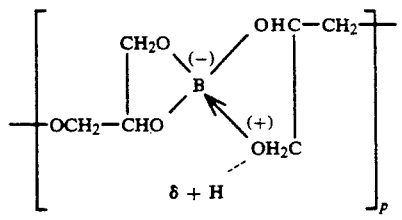

(I)

wherein p represents an integer of 10 or more.

The specific organic boron-containing polymer (C) has a high compatibility with the polyvinylalcohol resin (A) and the acetoacetylated polyvinylalcohol resin (D), and a thickening effect on the coating liquid for the protective layer.

The specific organic boron-containing polymer (C) effectively attracts the hydrophobic groups in the polyvinylalcohol resin (A) and the acetoacetylated polyvinylalcohol resin (D) to the boron atoms in the boron-containing polymer (C).

Accordingly, in the protective layer of the present invention, the hydrophobic groups (OH) in the molecules of the polyvinylalcohol resin (A) and the acetoacetylated polyvinylalcohol resin (D) are oriented substantially in one direction, and thus the resultant protective layer exhibits a superior barrier effect against the plasticizer and the oily substances.

The boron-containing polymer (C) is preferably present in an amount of 1 to 30 parts by weight, more preferably 2 to 15 parts by weight, per 100 parts by weight of the polyvinylalcohol resin (A), or of the sum of the polyvinylalcohol resin (A) and the acetoacetylated polyvinylalcohol resin (D).

If the content of the boron-containing polymer (C) is less than 1 parts by weight, the barrier effect of the resultant protective layer is often unsatisfactmry, and if the content of the boron-containing polymer (C) is more than 30 parts by weight, the resultant coating liquid for the protective layer has an excessively high viscosity and is excessively gelated, and thus exhibits a low pot life (storage durability).

Generally, the water-soluble polymeric materials for the protective layer in the heat-sensitive recording material must have a satisfactory film-forming property and exhibit a very good insolubility in plasticizers, oils, fats, and organic solvents. The water-soluble polymeric material must have a satisfactory film-forming property even at a relatively low temperature of about 100° C or less, and even under extremely dry conditions.

The acetoacetylated polyvinylalcohol resin having acetoacetic ester resin group has a very high reactivity, and thus can form a film having a practically satisfactory water-proof property by drying at a relatively low temperature.

Nevertheless, when a coating liquid for the protective layer is prepared by mixing only the acetoacetylated polyvinylalcohol resin with a cross-linking agent, the resultant coating liquid is disadvantageous in that a rapid increase in the viscosity and a ready gelation thereof occur, and thus this coating liquid is not satisfactory in practical use.

In the protective layer of the present invention, the addition of the polyvinylalcohol resin (A) to the water-soluble cross-linking agent (B), the boron-containing polymer (C), and optionally, the aceto-acetylated polyvinylalcohol resin (D) effectively prevents a rapid increase in the viscosity and a ready gelation of the coating liquid for the protective layer. Also, the polyvinylalcohol resin (A) effectively controls the pot life (storage durability) of the coating liquid to a desired level, and forms a protective layer from the coating liquid having a satisfactory resistance to water by only a drying operation at a relatively low temperature.

Further, the combination of the polyvinylalcohol resin (A) with the boron-containing polymer (C) effectively prevents an undesirable discoloration of the resultant protective layer. Usually, a dried film prepared only from the acetoacetylated polyvinylalcohol resin (D) and the water-soluble cross-linking agent (B) is easily discolored at the usual drying temperature.

Furthermore, the combination of the polyvinylalcohol resin (A) with the boron-containing polymer (C) effectively enhances the resistance of the resultant protective layer to the penetration of oils, fats, and plasticizers.

The protective layer of the present invention optionally contains an additional component consisting essentially of at least one member selected from lubricants fillers (pigments), in addition to the principal component comprising the mixture of the polyvinylalcohol resin (A), the water-soluble cross-linking agent (B), the boron-containing polymer (C) of the formula (I), and optionally, the acetoacetylated polyvinylalcohol resin (D).

The additional component effectively enhances the water-proof property of the resultant protective layer and prevents fading of the colored images on the recording material when the recording material is immersed in water.

Also, the additional component effectively prevents an undesirable sticking of a thermal head to the protective layer of the recording material and a deposit of grounds on the thermal head when the thermal head is brought into contact with the protective layer during the recording operation.

The fillers usable for the present invention include kaolin, clay, talc, calcium carbonate, sintered clay, titanium dioxide, diatomaceous earth, silica, synthetic aluminum silicate, synthetic magnesium silicate, aluminum oxide, pulverized polystyrene resin, and pulverized urea-formaldehyde resin.

In particular, the finely pulverized silicic acid having an oil absorption of 100 ml/100 g or more, an apparent specific volume of 3 ml/g or more, and an average particle size of 3.0 μm or less has a high compatibility with the principal component in the protective layer of the present invention, and very effectively prevents a sticking of the thermal head to the protective layer and a deposit of grounds on the thermal head, and enhances the printing property of the resultant recording material without lowering the resistance of the protective layer to plasticizers, oily substances, and water. Accordingly, the above-mentioned silicic acid particles effectively allow the recording of clear colored images having a high color depth on the recording material, with a relatively low heat energy.

The lubricants usable for the protective layer of the present invention include higher fatty acids, higher fatty acid amides, higher fatty acid-metal salts, paraffin wax, and microcrystalline wax.

Generally, in the recording material of the present invention, the principal component in the protective layer is present in an amount of 50% or more based on the entire weight of the protective layer. If the content of the principal component is less than 50%, the resistance of the resultant protective layer to plasticizers and oily substances is unsatisfactory.

Usually, in the heat-sensitive recording material of the present invention, the dry amount of the protective layer is controlled to a level such that the heat transfer from the thermal head to the heat-sensitive color-forming layer through the protective layer is not hindered. Usually, the amount of the protective layer is preferably in the range of from 1 to 10 g/m$^2$, more preferably from 2 to 7 g/m$^2$.

In the recording material of the present invention, the heat-sensitive color-forming layer may be covered by a single protective layer or by two or more protective layers.

In the heat-sensitive recording material of the present invention, the material used for forming the substrate sheet is not particularly limited, but preferably the substrate sheet is selected from paper sheets, fine paper sheets, art paper sheets, coated paper sheets in which a paper substrate sheet is coated with a mixture of an inorganic or organic pigment and a binder, cast-coated paper sheets, undercoated paper sheets, pasteboards, thin paper sheets, laminated paper sheets in which a paper substrate sheet is laminated with at least one heat-fusible resinous film, for example, a polyethylene or polypropylene film, synthetic paper sheets consisting essentially of a plastic resin, plastic resin films, and aluminum foils.

The substrate sheet preferably has a base weight of 30 to 200 g/m$^2$, and is coated with a heat-sensitive color-forming layer comprising a substantially colorless dye precursor, a color-developing agent reactive with the dye precursor upon heating to develop a color, and a binder.

The substantially colorless color-forming dye precursor is not restricted to specific compounds and can be selected from those usable for the conventional heat-sensitive recording materials.

For example, the dye precursor is selected from:
fluoran compounds, for example,
3-diethylamino-6-methyl-7-anilinofluoran,
3-pyrrolidino-6-methyl-7-anilinofluoran,
3-piperidino-6-methyl-7-anilinofluoran,
3-(N-methyl-N-cyclohexylamino)-6-methyl-7-anilinofluoran,
3-diethylamino-7-chloroanilinofluoran,
3-[N-ethyl-N-(p-methylphenyl)amino]-6-methyl-7anilinofluoran,
3-diethylamino-7-(methatrifluoromethyl) anilinofluorane,
3-[N-ethyl-N-tetrahydrofurfuryl]amino-6-methyl-7anilinofluoran,
3-[N-methyl-W-isopentyl]amino-6-methyl-7--amilinofluoran, and
3-[N,N-dibutyl]amino-6-methyl-7-anilinofluoran; triphenylmethane compounds, for example,
3,3-bis-(p-dimethylaminophenyl)-6-dimethyl-aminophthalide (crystal violet lactone)
3,3-bis-(p-dibutylaminophenyl)phthalide,
3,3-bis-(p-dimethylaminophenyl)phthalide, and
4-hydroxy-4,-dimethylamino-triphenylmethane lactone;
spiroran compounds, for example,
3-methyl-di-β-naphthaspiroran, and
1,3,3-trimethyl-6'-chloro-8'-methoxyindolino-benzospiroran;
Auramine leuco compounds;

and Rhodamine leuco compounds and phenothiazine leuco compounds.

The color-developing agent is not limited to a specific compound, as long as it can be liquefied or gasified at room temperature or higher, preferably 70° C or more, and is reactive with the dye precursor to develop a color.

Preferably, the color-developing agent usable for the present invention comprises at least one member selected from 4,4'-isopropylidene-diphenol (Bis-phenol A), 4,4'-isopropylidenebis(2-chlorophenol), 4,4'-isopropylidene-bis(2-methylphenol), 4,4-isopropylidenebis(2,1-tert-butylphenol], 4,4'-sec-butylidene diphenol, 4,4'-cyclohexylidene diphenol, 4-tert-butylphenol, 4-phenyl aphthol, 4-hydroxydiphenoxide, naphthol, p-naphthol, methyl-4-hydroxybenzoate, 4-hydroxy-acetophenone, salicylic acid anilide, novolak type phenol resins, halogenated novolak type phenol resins, 4,4'-thio-bis(3-methyl-6-tertbutylphenol), propyl p-hydroxybenzoate, isopropyl p-hydroxybenzoate, butyl p-hydroxybenzoate, isobutyl p-hydroxybenzoate, benzyl p-hydroxybenzoate, methylbenzyl p-hydroxybenzoate, aliphatic carboxylic acids, for example, oxalic acid, maleic acid, tartaric acid, citric acid, succinic acid and stearic acids, aromatic carboxylic acids, for example, benzoic acid, p-tertbutylbenzoic acid, phthalic acid, gallic acid, salicylic acid, 3-isopropylsalicylic acid, 3,5-di-α-methylbenzyl-salicylic acid, bis(4-hydroxyphenyl) sulfide, 1,7-di4(hydroxyphenylthio)-3,5-dioxaheptane, p-nitrobenzoic acid, salts of the above-mentioned organic colordeveloping compounds with polyvalent metals, for example zinc, magnesium, aluminum, calcium, titanium manganese, tin and nickel, 4,4'-dihydroxydiphenylsulfone, 2,4'-dihydroxydiphenylsulfone, 3,3'-dihydroxydiphenylsulfone, 3,3'-diamino-4,4'-dihydroxydiphenylsul'one, 3,3'-diamino-4,4'-dihydroxydiphenylsulfone, 3,3'-diallyl-4,4'-dihydroxydiphenylsulfone, 3,3'-dichloro-4,4'-dihydroxydiphenyl 4-hydroxy-diphenylsulfone, 4-hydroxy-4'-isopropyldiphenylsulfone, 4-hydroxy-4'-isopropyloxydiphenylsulfone, 4-hydroxy-4'-benzyloxydi-phenylsulfone, 2,4-dihydroxy-diphenylsulfone, 2,4-di-hydroxy-4'-methyldiphenylsulfone, and 3,4-dihydroxy-phenyl-p-trisulfone.

Preferably, the color-developing agent is present in an amount of 1 to 5 parts by weight, more preferably 1.5 to 3 parts by weight, per 1 part by weight of the dye precursor in the heat-sensitive color-forming layer.

The binder usable for the heat-sensitive color-forming layer of the present invention can be selected from those usable for the conventional recording materials.

Preferably, when the binder is mixed with an aqueous dispersion of the dye precursor and of the color-developing agent, the resultant mixture is not colored or coagulated, and does not exhibit a high viscosity. Also, the hinder must not binder the color-formation of the dye precursor, and forms a dry film having a satisfactory mechanical strength.

Since the heat-sensitive color forming layer is covered by the protective layer, the binder for the color-forming layer is not required to have a high sticking-prevention to the thermal head, a high prevention of the deposit of grounds on the thermal head, or a high resistance to an abrasion of the thermal head.

The binder usable for the present invention preferably comprises at least one member selected from water-soluble polymeric compounds, for example, polyvinylalcohol resins, starch, starch derivatives, hydroxyethyl cellulose, gum arabic, polyvinyl pyrrolidone, alkali-metal salts of acrylic acid (methacrylic acid)-acrylic ester (methacrylic ester) copolymers, alkali metal salts of styrene-maleic anhydride copolymers, alkali metal salts of isobutylene-maleic anhydride copolymers, and acrylic acid-acrylamide copolymers; and aqueous latexes or emulsions of water-insoluble polymeric materials, for example, styrene-butadiene copolymers, polyvinylacetate, and acrylic acid-acrylic ester copolymers.

The heat-sensitive color-forming layer optionally contains an additional ingredient comprising at least one member selected from fillers, surface active agents, and heat-fusible substances (or lubricants) which are usable for the conventional heat-sensitive recording materials.

The filler preferably comprises at least one member selected from inorganic materials, for example, calcium carbonate, magnesium carbonate, kaolin, clay, talc, sintered clay, silica, diatomaceous earth, synthetic aluminum silicate, synthetic magnesium silicate, zinc oxide, titanium dioxide, aluminum hydroxide, barium sulfate, surface-treated calcium carbonate particle and silica particles; and organic resinous materials, for example, urea-formaldehyde resins, styrene-methacrylic acid copolymer resins, and polystyrene resins.

The heat-fusible substance preferably comprises at least one member selected from aliphatic acid amide compounds, for example, stearic acid amide, ethylene stearate-bis amide, oleic acid amide, palmitic acid amide, coconut fatty acid amide, and behenic acid amide; waxes, for example, zinc stearate, calcium stearate, polyethylene wax, carnauba wax, paraffin wax, and ester wax; and hindered phenol compounds, for example, dimethylester of terephthalic acid, dibutylester of terephthalic acid, dibenzylester of terephthalic acid, dibutylester of isophthalic acid, phenylester of 1-hydroxynaphthoic acid, 1,2-di(3-methylphenoxy)ethane, 1,2-diphenoxyethane, 1-phenoxy-2-(4-methylphenoxy)ethane, diphenyl carbonate, p-benzylbiphenyl, 2,2'-methylene-bis(4-methyl-6-tert-butylphenol), 4,4'-butylidenebis(6-tert-butyl-3-methylphenol, 1,1,3-tris(2-methyl-4-hydroxy-5-tert-butylphenyl)butane, 2,2'-methylene bis(4-ethyl-6-tert-butylphenol), 2,4-di-tert-butyl-3-methylphenol, and 4,4'-thiobis(3-methyl-tert-butylphenol); sensitizing agents, lubricant, antioxidants and ultraviolet ray absorbing agents, for example, 2-(2'-hydroxy-5'-methylphenyl)benzotriazol, -hydroxy-4-benzyloxybenzophenone.

There is no restriction on the content of the heat-fusible substance in the heat-sensitive color-forming layer, but preferably the heat-fusible substance is present in an amount of 4 parts by weight or less per part by weight of the color-developing agent. The heat-sensitive recording material of the present invention is prepared by coating a surface of the substrate sheet with a coating liquid comprising the dye precursor, the color-developing agent, the binder, and optionally the additional ingredient; drying the resultant coating liquid layer to form a heat-sensitive color-forming layer; coating the heat-sensitive color-silica forming layer with a coating liquid comprising the polyvinylalcohol resin (A), the water-soluble cross-linking agent (B), the boron-containing polymer (C) of the formula (I), and optionally, the polyvinylalcohol derivative resin (D) and the additional component; and drying the coating liquid layer to provide a protective layer on the heat-sensitive color-forming layer.

EXAMPLES

The present invention will be further explained by way of specific examples, which are representative and do not in any way restrict the scope of the present invention.

EXAMPLE 1

A heat-sensitive recording sheet was produced by the following procedures. (1) Preparation of Dye Precursor Dispersion (a)

A mixture having the composition shown below was prepared.

| Component | Amount (part by weight) |
|---|---|
| 3-(N-methyl-N-cyclohexylamino)-6-methyl-7-anilinofluoran | 6 |
| 10% polyvinylalcohol resin aqueous solution | 10 |

The mixture was placed in a sand grinder to pulverize the dye precursor particles to an average size of 3 μm or less, to provide a dye precursor dispersion (a).

(2) Preparation of Color-developing Acent Dispersion (b)

A mixture having the composition shown below was prepared.

| Component | Amount (part by weight) |
|---|---|
| 4,4'-isopropylidenediphenol | 25 |
| Stearic acid amide | 16 |
| 10% polyvinylalcohol resin aqueous solution | 100 |

The mixture was placed in a sand grinder to pulverize the color-developing agent particles to an average size of 3 μm or less, to provide a color developing agent dispersion (b).

(3) Preparation of Coating Liquid (c) for Protective Layer

A mixture having the composition shown below was prepared.

| Component | Amount (part by weight) |
|---|---|
| 10% polyvinylalcohol resin aqueous solution | 50 |
| 10% organic boron-containing polymer *1 aqueous solution | 10 |
| 30% pulverized silicic acid aqueous dispersion *2 | 10 |
| 30% polyformaldehyde aqueous solution | 2 |
| 30% zinc stearic aqueous dispersion | 2 |

Note:
*1 Available under the trademark of Hiboron DDGB-90, from Boron International Co., Ltd. Average molecular weight: 10,000, Content of boron: 6.2%
*2 Pulverized silicic acid having an apparent specific volume of 4.1 ml/g and an oil absorption of 120 ml/100 g The mixture was evenly stirred in a vessel to provide a protective layer-coating liquid (c).

(4) Formation of Heat-sensitive Color-Forming Layer

A coating liquid (d) for the heat-sensitive color-forming layer was prepared by mixing 40 parts by weight of a 60% calcium carbonate aqueous dispersion, with 30 parts by weight of the dye precursor dispersion (a), 200 parts by weight of the color-developing agent dispersion (b), and 100 parts by weight of a 10% polyvinylalcohol resin aqueous solution while stirring.

The resultant coating liquid (d) was applied to a surface of a substrate sheet consisting of a paper sheet having a base weight of 50 g/m$^2$ to an extent such that after drying and solidifying, the resultant dry coating layer was in a weight of 7.0 g/m$^2$, and the coated liquid layer was dried to form a heat-sensitive color forming layer.

The surface of the heat-sensitive color-forming layer was treated by a calender to smooth the surface to a Beck smoothness of 250 seconds.

(5) Formation of protective layer

The calendered surface of the heat-sensitive color-forming layer on the substrate sheet was coated with the protective layer-coating liquid (c) to an extent such that, after drying and solidifying, the resultant dry coating layer was in a weight of 3 g/m$^2$, and the coated liquid layer was dried to form a protective layer.

The polyvinylalcohol resin used in the above-mentioned procedures had a degree of polymerization of 500 and a degree of saponification of 98%.

The resultant heat-sensitive recording sheet was conditioned at room temperature for three days, and then subjected to a recording operation by using a heat-sensitive facsimile machine (available under the trademark of Copix 7100, from Toshiba) to form a solid black colored image on the color-forming layer.

The initial darkness of the solid black colored image was measured by a reflection color darkness tester (available under a trademark of Macbeth Darkness Tester RD-915 from Kollmorgen (o). The result of the test is shown in Table 1.

Test pieces having the solid black colored image were prepared from the above-mentioned recording sheet and were subjected to the following tests.

(1) Resistance to Water

A test piece was immersed in water at room temperature for 24 hours and then taken out and dried. The resistance of the protective layer to water was evaluated by observing the dissolved or swollen condition of the protective layer. The barrier effect of the protective layer to water for protecting the colored image thereunder was evaluated by comparing the darkness of the black colored image after the immersion in water, with the initial darkness thereof.

(2) Resistance to Plasticizer

The front surface of the test piece was brought into close contact with a soft polyvinylchloride film and the resultant laminate was pressed at a temperature of 20° C. and under a load of 300 g/cm$^2$, for 24 hours. The barrier effect of the protective layer with regard to the plasticizer, for protecting the colored image thereunder, was evaluated in the same way as mentioned above.

(3) Barrier Effect Against Oily Substance

A cotton seed oil was applied to the front surface of the test piece and the oil-applied test piece was left to stand at a temperature of 20° C. or 40° C. for 24 hours. The barrier effect of the protective layer against the cotton seed oil for protecting the colored image thereunder was evaluated in the same way as mentioned above.

The results of the tests are shown in Table 1.

COMPARATIVE EXAMPLE 1

The same procedures as those in Example 1 were carried out excepted that, in the preparation of the coating liquid (c) for the protective layer, the 10% polyvinylalcohol resin aqueous solution was present in an amount of 60 parts by weight and the 10% boron-containing polymer aqueous solution was omitted.

The results of the tests are shown in Table 1.

TABLE 1

| Item Example No. | Initial darkness of colored image | Resistance to water *4 | Resistance *3 to plasticizer | Resistance to oil *4 20° C. | Resistance to oil *4 40° C. | Anti-sticking property *4 |
|---|---|---|---|---|---|---|
| Example 1 | 1.28 | 5 | 1.28 | 5 | 4 | 5 |
| Comparative Example 1 | 1.26 | 4 | 1.05 | 3 | 1 | 4 |

Note:
*3 Darkness of colored image after polyvinylchloride film contact test
*4 5 Excellent 4 Good 3 Satisfactory 2 Not good 1 Bad

EXAMPLE 2

The same procedures as in Example 1 were carried out except that the protective layer coating liquid (c) was replaced by a coating liquid (e) having the following composition.

| Component (Coating liquid (e)) | Amount (part by weight) |
|---|---|
| 10% polyvinylalcohol resin aqueous solution | 20 |
| 10% acetoacetylated polyvinylalcohol resin aqueous solution *5 | 35 |
| 10% organic boron-containing polymer aqueous solution *1 | 20 |
| 30% pulverized silicic acid aqueous dispersion *2 | 8 |
| 30% polyformaldehyde aqueous solution | 3 |
| 30% zinc stearate aqueous dispersion | 1 |

Note:
*1 and *2 as shown in Table 1.
*5 Acetoacetylated polyvinylalcohol resin hving a degree of acetoacetylation of 5%, a degree of saponification of 93%, and a degree of polymerization of 1000.

The results of the tests are shown in Table 2.

EXAMPLE 3

The same procedures as in Example 1 were carried out except that the protective layer coating liquid (c) was replaced by a coating liquid (f) having the following composition.

| Component (Coating liquid (f)) | Amount (part by weight) |
|---|---|
| 10% polyvinylalcohol resin aqueous solution | 20 |
| 10% acetoacetylated polyvinylalcohol resin aqueous solution *5 | 35 |
| 10% organic boron-containing polymer aqueous solution *1 | 20 |
| 60% pulverized kaolin aqueous dispersion | 4 |
| 30% polyformaldehyde aqueous solution | 3 |
| 30% zinc stearate aqueous dispersion | 1 |

The results of the tests are shown in Table 2.

EXAMPLE 4

The same procedures as in Example 1 were carried out except that the protective layer coating liquid (c) was replaced by a coating liquid (g) having the following composition.

| Component (Coating liquid (g)) | Amount (part by weight) |
|---|---|
| 10% polyvinylalcohol resin aqueous solution | 55 |
| 10% organic boron-containing polymer aqueous solution *1 | 20 |
| 30% pulverized silicic acid aqueous dispersion *2 | 10 |
| 30% polyformaldehyde aqueous solution | 2 |

The results of the tests are shown in Table 2.

COMPARATIVE EXAMPLE 2

The same procedures as in Example 2 were carried out except that, in the preparation of the protective layer coating liquid (e), the 10% organic boron-containing polymer aqueous solution was omitted.

The results of the tests are shown in Table 2.

COMPARATIVE EXAMPLE 3

The same procedures as in Example 3 were carried out except that, in the preparation of the protective layer coating liquid (f), the 10% organic boron-containing polymer aqueous solution was omitted.

The results of the tests are shown in Table 2.

COMPARATIVE EXAMPLE 4

The same procedures as in Example 4 were carried out except that, in the preparation of the protective layer-coating liquid (g), the 10% organic boron-containing polymer aqueous solution was omitted.

The results of the tests are shown in Table 2.

COMPARATIVE EXAMPLE 5

The same procedures as in Example 2 were carried out except that the protective layer coating liquid (e) was replaced by a coating liquid (h) having the following composition.

| Component (Coating liquid (h)) | Amount (part by weight) |
|---|---|
| 10% acetoacetylated polyvinyl-alcohol resin aqueous solution *5 | 55 |
| 30% pulverized silicic acid aqueous dispersion *2 | 8 |
| 30% polyformaldehyde aqueous solution | 3 |
| 30% zinc stearate aqueous dispersion | 1 |

The results of the tests are shown in Table 2.

TABLE 2

| Item Example No. | Initial darkness of colored image | Resistance to water *4 | Resistance to plasticizer *3 | Resistance to oil *4 20° C. | Resistance to oil *4 40° C. | Anti-sticking property *4 | Coating property |
|---|---|---|---|---|---|---|---|
| Example | | | | | | | |
| 2 | 1.29 | 5 | 1.28 | 4 | 4 | 5 | Satisfactory |
| 3 | 1.31 | 5 | 1.30 | 4 | 4 | 4 | " |
| 4 | 1.30 | 4 | 1.28 | 4 | 4 | 5 | " |
| Comparative Example | | | | | | | |
| 2 | 1.28 | 4 | 1.05 | 2 | 1 | 3 | " |
| 3 | 1.30 | 4 | 1.09 | 3 | 2 | 2 | " |
| 4 | 1.27 | 4 | 1.06 | 3 | 1 | 2 | " |
| 5 | 1.25 | 5 | 1.10 | 4 | 2 | 4 | Unsatisfactory *6 |

Note:
*6 Coating liquid had high viscosity and was difficult to evenly coat.

As the above examples clearly indicate, the heat-sensitive recording materials of the present invention exhibit a superior resistance to water, plasticizer, and oily substances. Accordingly, the heat-sensitive recording materials of the present invention can be advantageously employed in various fields; for example, for heat-sensitive recording tickets for automatic ticket machines, coupon tickets and commuter's tickets which are retained over a long period, and labels to be attached to polyvinyl chloride films for packing perishable foods in a POS barcode price-indicating system, or oily foods, for example, fresh meat.

Also, the heat-sensitive recording materials of the present invention are useful for facsimile recording sheets and printing sheets to be retained over a long period.

What is claimed is:

1. A heat-sensitive recording material comprising:

a substrate sheet;

a heat-sensitive color-forming layer formed on a surface of the substrate sheet and comprising a substantially colorless dye precursor, a color-developing agent reactive with the dye precursor upon heating to develop a color, and a binder and at least one protective layer formed on the heat-sensitive color-forming layer and comprising, as the principal component, a mixture of:

(A) a polyvinylalcohol resin;

(B) a water-soluble cross-linking agent; and (C) an organic boron-containing polymer of the formula (I):

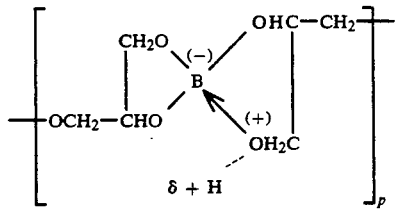

wherein p represents an integer of 10 or more.

2. The heat-sensitive recording material as claimed in claim 1, wherein the principal component in the protective layer further comprises:

(D) an acetoacetylated polyvinylalcohol resin in addition to the polyvinylalcohol resin (A), the water-soluble cross-linking agent (B), and the organic boron-containing polymer (C) of the formula (I).

3. The heat-sensitive recording material as claimed in claim 2, wherein the acetoacetylated polyvinylalcohol resin (D) has a degree of polymerization of 700 to 2000.

4. The heat-sensitive recording material as claimed in claim 2, wherein the acetoacetylated polyvinylalcohol resin is water-soluble and has acetoacetic ester group attached in an amount of 0.05 molar % or more to backbone polyvinylalcohol molecule chains.

5. The heat-sensitive recording material as claimed in claim 2, wherein the acetoacetylated polyvinylalcohol resin (D) is present in an amount of 1 to 200 parts by weight per 100 parts by weight of the polyvinylalcohol resin (A).

6. The heat-sensitive recording material as claimed in claim 2, wherein the water-soluble cross-linking agent (B) is present in an amount of 1 to 30 parts by weight, per 100 parts by weight of the sum of the polyvinyalcohol resin (A) and the acetoacetylated polyvinylalcohol resin (A) and the acetoacetylated polyvinylalcohol resin (D).

7. The heat-sensitive recording material as claimed in claim 2, wherein the organic boron-containing polymer (C) is present in an amount of 1 to 30 parts by weight, per 100 parts by weight of the sum of the polyvinylalcohol resin (A) and the acetoacetylated polyvinylalcohol resin (D).

8. The heat-sensitive recording material as claimed in claim 1, wherein the polyvinylalcohol resin (A) has a degree of polymerization of 300 to 1700.

9. The heat-sensitive recording material as claimed in claim 1, wherein the polyvinylalcohol resin has a degree of saponification of 70 to 100%.

10. The heat sensitive recording material as claimed in claim 1, wherein the water-soluble cross-linking agent (B) comprises at least one compound selected from the group consisting of glyoxal, polyformaldehydes, polyethyleneimines, epoxy group-containing polyamides, glyceroldiglycidylether, dimethylol urea, ammonium persulfate, iron (III) chloride, magnesium dichloride, ammonium chloride and boric acid.

11. The heat-sensitive recording material as claimed in claim 1 wherein the water-soluble cross-linking agent (B) is present in an amount of 1 to 30 parts by weight per 100 parts by weight of the polyvinylalcohol resin (A).

12. The heat-sensitive recording material as claimed in claim 1 wherein the organic boron-containing polymer (C) is present in an amount of 1 to 30 parts by weight per 100 parts by weight, of the polyvinylalcohol resin (A).

13. The heat-sensitive recording material as claimed in claim 1 or 2, wherein the principal component in the protective layer is present in an amount of 50% or more based on the entire weight of the protective layer.

14. The heat-sensitive recording material as claimed in claim 1 or 2, wherein the protective layer further comprises an additional component comprising at least one member selected from the group consisting of lubricants and fillers.

15. The heat-sensitive recording material as claimed in claim 1 or 2, wherein the protective layer is present in an amount of 1 to 10 $g/m^2$.

16. The heat-sensitive recording material as claimed in claim 1, wherein the dye precursor is present in an amount of from 5% to 20% based on the total weight of the heat-sensitive color-forming layer.

17. The heat-sensitive recording material as claimed in claim 1, wherein the color-developing agent is present in an amount of 1 to 5 parts by weight per part by weight of the dye precursor.

18. The heat-sensitive recording material as claimed in claim 1, wherein the heat-sensitive color-forming layer is present in an amount of 1 to 15 $g/m^2$.

* * * * *